United States Patent [19]

Port

[11] 4,318,533

[45] Mar. 9, 1982

[54] APPARATUS FOR MAINTAINING TENSION ON A TENSION CABLE

[76] Inventor: Walter Port, Würzenbachstrasse 69, St. Ingbert-Reichenbrunn/Saar, Fed. Rep. of Germany, 6670

[21] Appl. No.: 58,854

[22] Filed: Jul. 19, 1979

[30] Foreign Application Priority Data

Jul. 25, 1978 [DE] Fed. Rep. of Germany ..... 2832567

[51] Int. Cl.[3] ..... B66D 1/50

[52] U.S. Cl. ..... 254/273

[58] Field of Search ..... 254/273, 272; 242/75.53, 86.5 R; 104/117, 196

[56] References Cited

U.S. PATENT DOCUMENTS

| | | | |
|---|---|---|---|
| 1,433,079 | 10/1922 | Jett | 254/273 |
| 2,563,660 | 8/1951 | Rebut et al. | 242/75.53 |
| 3,032,321 | 5/1962 | Plumettaz | 254/272 |
| 3,045,974 | 7/1962 | Lawrence | 242/75.53 |
| 3,588,049 | 6/1971 | Nectoux . | |

FOREIGN PATENT DOCUMENTS

| | | |
|---|---|---|
| 874209 | 4/1953 | Fed. Rep. of Germany . |
| 1242541 | 6/1967 | Fed. Rep. of Germany . |
| 1499061 | 9/1969 | Fed. Rep. of Germany . |
| 2526461 | 5/1976 | Fed. Rep. of Germany . |

*Primary Examiner*—Philip R. Coe
*Assistant Examiner*—Timothy F. Simone
*Attorney, Agent, or Firm*—John J. Dennemeyer

[57] ABSTRACT

An apparatus for maintaining tension on a tension cable which is wound on the drum of a winch and connected at one end to a position varying object, especially for maintaining the tension of a power cable leading to a travelling coal extraction machine. The winch, preferably a conventional pressure drive operated hauling coiler can be regulated and driven reversibly and it can produce also at stand-still a continuous rotary moment. A tensioning device having a tensioning pulley 11 is also provided and is subjected to the force of the spring 14, the tension cable 6 being guided around the pulley 11 so that over the spring force a desired nominal tension can be set on the tension cable. Position changes of the tension pulley produce over an actuating linkage 14 a control of the winch so that the tension pulley returns into the original equilibrium position. This control process may be accompanied by running the cable off the winch or hauling it in. Instead of the tension pulley 11 the tension device can comprise also another movable element for example the drum 9*a* of the winch 9 when the winch is to be guided movably as a whole against the spring force.

6 Claims, 3 Drawing Figures

APPARATUS FOR MAINTAINING TENSION ON A TENSION CABLE

The invention relates to an apparatus for maintaining tension on a traction cable or rope, which is connected to a position variable object that is independent of the cable force, especially for the indirect tensioning of a power cable leading to a coal extraction machine travelling to and fro. The problem to be solved by the invention resides in the necessity of guiding power lines or other conduits leading to a movble work machine over an auxiliary means by which the conduits are supported in a predetermined position so that they are not run over by the work machine travelling back and forth. The most commonly used auxiliary means for solving this problem is the cable tractor chain. It is expensive and cannot be used for random long travel movements of a work machine. There exist also cable drums with inherent rotary moment for maintaining tension on a cable but during unwinding of the cable the counter moment must be overcome whereby the tension increases in the cable.

It is an object of the invention to provide an apparatus for maintaining tension on a tension cable by which the tension in the cable is maintained essentially constant which has the effet that upon unwinding the cable there is no need to overcome at a departing point to which the tension cable is connected an inherent counter moment on a coiling apparatus.

This task can be achieved by providing a winch which is controllable and reversable and which is designed to furnish continuously a rotary moment and thus a continuous tension force in the tension cable, including a drum for receiving one end of the tension cable, a tensioning device for exerting a counter tension force in the tension cable with an element which is movable in relation to the tension in the tension cable, at which element engages a sustained spring force determining a desired tension, the spring force being given a calculated strength such that the movble element is in the equilibrium position when the continuous tension force of the winch is equal to the desired counter tension force exerted by the tensioning device, and a control for regulating the winch in relation to the position changes of the movable elements of the tensioning device in the sense and scope that the movable element is returned into the equilibrium position.

The device according to the invention including a winch for the on- and off-winding of the tension cable, which can be also the power conduit itself, may be called a collecter winch which is actuated over a control device in relation to deviations from a normal tension within the tension cable. It is controlled in the sense of the winding on when the nominal tension in the tension cable drops down because a reference point approaches the winch or conversely. The constant tension which may be set in this manner in the tension cable under the inherent continuous rotary moment of the winch prevents jerky tension loads at the connecting point and introductions of power or other conduits in the travelling work machine because each impact is absorbed by the movable element of the tension device.

The invention includes also the area of application where the end of the tension cable is fixed and the apparatus itself is movable. In this case consideration is given to the situations where a cable is run off a ship and the cable is to be maintained constant in its tension under the ship movement in a vertical and/or horizontal direction, for example in laying cables or when the ship is at anchor. One can also imagine situations in which the tension of a cable depending from a helicopter in the air is to be held constant, for example when several helicopters are used to carry heavy loads. Until now one has used for this purpose complicated electronic helicopter controls.

A special solution which can be particularly recommended according to the invention consists in that the winch is a conventional air pressure operated hauling coiler with a hand lever which can be operated from a central stop position to a forward and rearward drive, the lever being connected to a linkage which follows the position changes of the movable element of the tension device.

The movable element of the tension device for generating the counter tension force in the cable is appropriately a tension pulley over which the tension cable is guided, wherein the tension pulley is mounted at the short lever arm of a balance beam at whose longer lever arm a tension spring and an actuation rod leading to the hand lever of the winch are connected. In this arrangement the equilibrium position of the tension pulley is set when the tension holds the balance beam and over the actuating linkage the hand lever of the winch in the position in which the moment from tension force at the tension pulley and short lever arm are equal to the moment from the spring force and the longer lever arm under which the spring engages at the balance beam.

For setting the desired nominal tension in the tension cable the lever arm relationship and/or the spring force can be variable. Furthermore it is appropriate to limit the position chnge of the movable element or of the tension pulley by abutments which are associated with setting positions of the winch control in which the winch is fully connected. When for example by a quick displacement of the object at which the tension cable ultimately engages a strong deflection of the movable element or of the tension pulley take place the winch is fully connected in a stop position for unwinding or winding the tension cable.

When the winch, the tension device and the control for the winch constitute a transportable unit the apparatus according to the invention is to be set up always at the most favorable spot in providing an adaptation to the local conditions.

In order to avoid that power or other cables which are to be maintained under tension must be guided themselves over the winch it is proposed to guide the power cable, for the indirect tensioning of a power cable or the like, around a deflection pulley mounted at the end of the tension cable. In this case the apparatus according to the invention requires besides the power input for the winch no further power conducting connections as also over a simple cable and the deflection pulley any type of cables or flexible conduits may be held under tension. It is merely necessary to choose the deflection pulley in a corresponding manner whereby the possibility exists to provide a multiple deflection pulley for different flexible conduits which all lead to one and the same movable object. In this case it is recommended to provide, in adaptation to occasionally varying diameters of the different conduits also individual deflection pulleys of different diameter, so that the unwinding lengths of conduits during position changes of the multiple deflection pulley and thus their tensions among each other remain as constant as possible.

An embodiment of a collector winch according to the invention is illustrated in the drawing in which.

Figure 1:
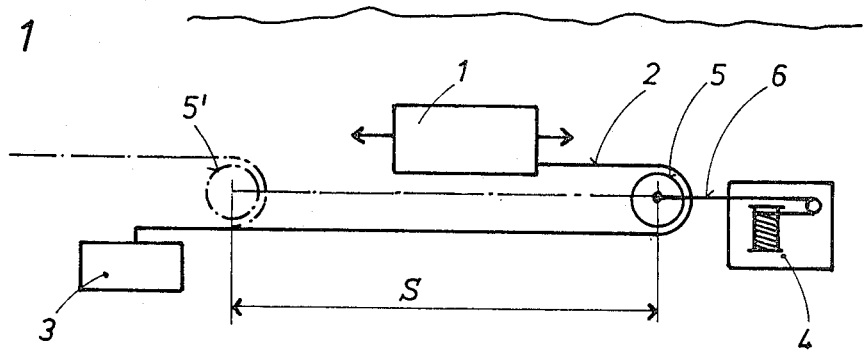
FIG. 1 is a diagrammatic representation of the arrangement of a collector winch in combination with a travelling coal extraction machine.

Referring to the drawing, FIG. 1 shows a travelling coal extration machine 1 from which leads a power cable 2 which is connected to a stationary switch box 3. This power cable 2 is to be maintained under tension during the travelling movements of the coal extraction machine 1 by means of the collector winch 4 of the invention so that it is not run over by the coal extraction machine. For this purpose the power cable 2 is guided over a deflection pulley 5 to the switch box 3 wherein the deflection pulley 5 is the end point of a tension cable 6 which leads to the winch according to the invention. The power cable 2 is thus maintained under tension over the tension cable 6 indirectly. When the coal extracting machine 1 is moved to the left the deflection pulley 5 follows into the end position 5' shown in dotted line. The maximum displacement path S of the deflection pulley 5 shown in the illustrated embodiment amounts to half the maximum travelling path of the coal extraction machine 1 toward the left.

Figure 3:
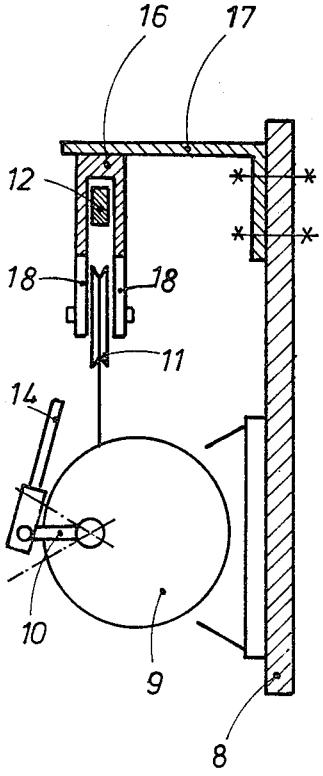
FIG. 3 is a section aling line III—III in FIG. 2.
Figure 2:
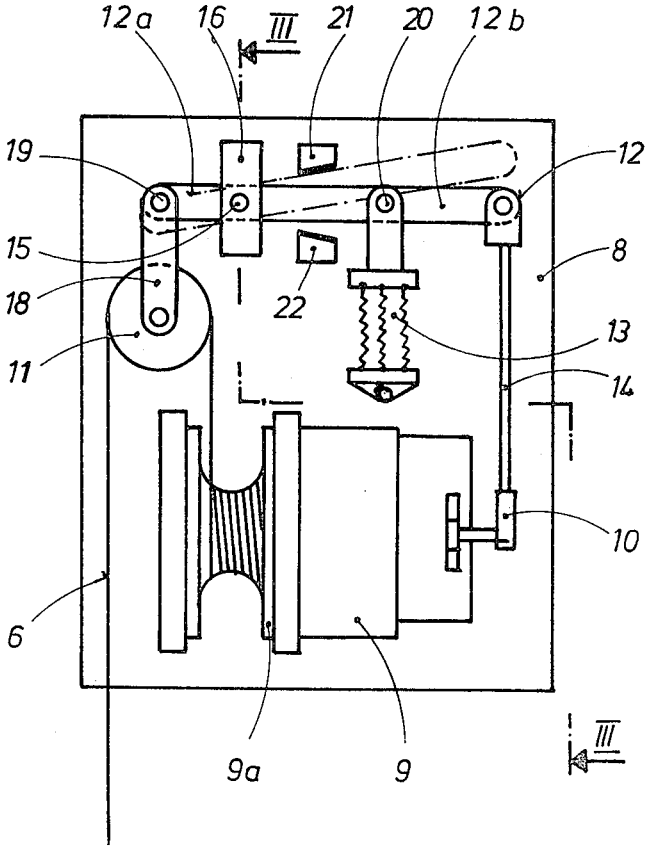
FIG. 2 is a plan view of the collector winch as a transportable unit.

The collector winch according to the invention shown in FIGS. 2 and 3 comprises first a base plate 8 with a conventional air pressure operated hauling coiler 9 mounted thereon, the hand lever 10 of the coiler 9 being in the horizontal central stop position as shown in FIG. 3. This hand lever may be moved into the two pivot positions shown in dotted lines for forward and rearward travel so that the hauling coiler 9 is reversible and provided with a controllable drive. The tension cable 6 is wound on the drum **9*a* of the hauling coiler 9, the cable 6 leading to the shaft of the deflection pulley 5. As shown in FIG. 2 the tension cable 6 travels over a position variable tension pulley 11 from which the control for the hand lever 10 of the hauling coiler 9 is actuated. The tension pulley 11 is mounted at the short lever arm 12*a* of a balance beam 12 at whose longer lever arm 12*b* a tension spring 13 and an actuation rod 14 leading to the hand lever 10 are connected. The balance beam 12 is mounted pivotably around the rotary shaft 15 of a fork 16 which is connected over a support arm 17 to the base plate 8. The tension pulley 11 is articulated over a double strap 18 at the end of the short lever arm 12*a* of the balance beam 12. In FIG. 3 this double strap 18 extends partly behind the fork 16** shown in section.

The lever ratios of the balance beam 12 and the force of spring 13 are so designed that the tension pulley 11 guided movably in opposition to the spring force is at equilibrium under the desired tension force engaging at the cable. The tension force engaging at the cable 6 is generated by the steady torque of the hauling coiler 9. If for example the lever ratio between the short lever arm **12*a* corresponding to the interval of the articulation points 15–19 and the long lever arm 12*b* corresponding to the interval of the articulation points 16–20 equal to 1:3 the balance beam 12 is in the equilibrium condition when with a force of for example 2000 N at the tension pulley 11 corresponding to a 2000 N tension force within cable (6) the spring force amounts to 2000 N:2 or 660 N. In the equilibrium position of the balance beam 12 the length of the actuation rod 14 is so calculated that the hand lever 10 is deflected somewhat relative to the central stop position in the sense that the hauling coiler 9 stedily reduces the torque necessary to have a force of 2000 N engaged at the cable 6**.

When with reference to the embodiment of FIG. 1 the coal extraction machine 1 travels to the left and with it also the deflection pulley 5 the tension force in the cable 6 increases with the result tht the tension pulley 11 travels out in a corresponding manner. The maximum deflection limited by an abutment 21 of the balance beam 12 is illustrated in dotted line in FIG. 2. The deflection of the balance beam 12 in the other direction is limited by an abutment 22. With the two abutments setting positions of the control are associated in which the hauling coiler 9 is fully connected in one or the other direction of rotation.

As mentioned the balance beam 12 is displaced in the direction of the dotted line pivot position when the tension force in the cable is increased. The hand lever 10 is thereby adjusted over the actuating rod 14 to a return travel of the hauling coiler 9 i.e. the cable drum **9*a* allows the cable to unwind. Accordingly the tension pulley 11 pulls back again under the force of a spring until the equilibrium condition at the balance beam or the nominal tension force in cable 6 is reestablished. The hand lever 10 is then again in the position which corresponds in the rest position of the deflection pulley 5 to the desired tension force in the cable. If the cable force drops for example during the travel of the coal extraction machine to the right the balance beam 12 swings in the other direction and the drum 9*a* is rotated in the sense of a winding up of cable 6. The hauling coiler 9 is always connected by the control described in relation to position changes of the tension pulley 11 in that direction of rotation which attempts to return the tension pulley into the equilibrium position in which the hauling coiler 9 is stopped or a continuous predetermined rotary moment acts on the drum 9*a***.

As a variation from the embodiment of the invention illustrated in the drawing it is conceivable that the winch is mounted on a platform which is movable back and forth in the direction of the tension cable, the tension apparatus being in engagement with this platform. In this embodiment the drum of the winch is itself the movable element of the tension apparatus.

What is claimed is:

1. An apparatus for maintaining a continuous tension on a tension cable which is connected to a position varying object independently of the cable force, especially for the indirect tensioning of a power cable leading to a coal extracting machine travelling back and forth, the apparatus comprising:

(a) a winding drum for receiving one end of the tension cable;

(b) means operatively connected to said drum for selectively driving said drum in either the forward or reverse direction, or holding said drum in a rest position;

(c) means for controlling the speed and direction of rotation of said driving means;

(d) tensioning means for exerting a counter-tension on the tension cable;

(e) means for sensing the tension in the cable and moving in relation to changes in the magnitude and direction of the tension on the cable;

(f) means for biasing connected to said sensing means for providing a desired tension on the cable, said biasing means having a predetermined force such that said sensing means assumes an equilibrium position when the tension force exerted by said driving means on the cable is equal to the counter-tension exerted by the tensioning means to insure that the cable is continuously under tension even when said drive means is at rest; and (g) said sensing means being connected to said controlling means to regulate the direction and speed of rotating of said driving means in response to positional changes in the sensing means so that said sensing means is returned to the equilibrium position in which said driving means is in said rest position, delivering a steady torque to maintain said equilibrium position.

2. An apparatus according to claim 1, wherein:

(a) said driving means is an air pressure driven hauling coil;

(b) said controlling means is a hand lever which can be set from a central stop position to a forward and rearward drive position; and (c) said sensing means is connected to said lever by an actuating rod which follows the positional changes of said sensing means.

3. An apparatus according to claim 1, wherein:

(a) said sensing element is a movable pulley over which the tension cable is guided; and (b) said pulley being rotatably mounted on a balance beam pivotally mounted along its length to provide a short lever arm on which said pulley is mounted and a longer lever arm connected to said biasing means as well as said actuating rod leading to said hand lever.

4. An apparatus as in claim 1, including a pair of abutments for limiting the positional changes of said sensing means.

5. An apparatus as in claim 4, wherein said abutments are positioned on either side of said longer lever arm.

6. An apparatus according to claim 1 including a deflection pulley affixed to one end of the tension cable over which the power cable is guided to provide indirect tensioning of the power cable.

* * * * *